US008091495B2

(12) United States Patent
Donnelly et al.

(10) Patent No.: US 8,091,495 B2
(45) Date of Patent: Jan. 10, 2012

(54) COMPRESSED NATURAL GAS BARGE

(75) Inventors: Frank Wegner Donnelly, North Vancouver (CA); Michael H. Kobler, Sebastopol, CA (US); John D. Watson, Evergreen, CO (US)

(73) Assignee: Frank Wegner Donnelly, North Vancouver, BC (CA)

( * ) Notice: Subject to any disclaimer, the term of this patent is extended or adjusted under 35 U.S.C. 154(b) by 107 days.

(21) Appl. No.: 12/481,315

(22) Filed: Jun. 9, 2009

(65) Prior Publication Data

US 2010/0050925 A1 Mar. 4, 2010

Related U.S. Application Data

(60) Provisional application No. 61/059,978, filed on Jun. 9, 2008.

(51) Int. Cl.
*B63B 25/08* (2006.01)

(52) U.S. Cl. ..... 114/74 A; 114/256

(58) Field of Classification Search ..... 114/256, 114/74 A

See application file for complete search history.

(56) References Cited

U.S. PATENT DOCUMENTS

| | | | | |
|---|---|---|---|---|
| 4,749,384 | A | 6/1988 | Nowobilski et al. | |
| 4,826,644 | A * | 5/1989 | Lindquist et al. | 264/71 |
| 6,260,501 | B1 * | 7/2001 | Agnew | 114/257 |
| 6,339,996 | B1 * | 1/2002 | Campbell | 114/74 R |
| 6,474,101 | B1 * | 11/2002 | Quine et al. | 62/657 |
| 6,725,671 | B2 * | 4/2004 | Bishop | 62/45.1 |
| 6,932,121 | B1 * | 8/2005 | Shivers, III | 141/1 |
| 7,137,260 | B2 | 11/2006 | Perry | |

OTHER PUBLICATIONS

International Preliminary Report on Patentability for International (PCT) Patent Application No. PCT/US09/46760, mailed Dec. 23, 2010.

"CNG: An Alternative Transport for Natural Gas Instead of LNG", Asim Deshpande and Michael J. Economieds, University of Houston, approximate publication date Dec. 2004.

International Search Report for International (PCT) Patent Application No. PCT/US09/46760, mailed Jul. 28, 2009.

Written Opinion for International (PCT) Patent Application No. PCT/US09/46760, mailed Jul. 28, 2009.

* cited by examiner

*Primary Examiner* — Stephen Avila
(74) *Attorney, Agent, or Firm* — Sheridan Ross P.C.

(57) ABSTRACT

The present invention is directed to a maritime vessel that uses a solid or semi-solid material to enclose substantially natural gas storage vessels in the hold of the vessel.

19 Claims, 10 Drawing Sheets

COMPRESSED NATURAL GAS BARGE

CROSS REFERENCE TO RELATED APPLICATION

The present application claims the benefits, under 35 U.S.C. §119(e), of U.S. Provisional Application Ser. No. 61/059,978 entitled "Compressed Natural Gas Barge", filed Jun. 9, 2008 which is incorporated herein by this reference.

FIELD

The present invention relates to a method and apparatus to transport large amounts of compressed natural gas and other cargo in barges constructed largely of reinforced concrete.

BACKGROUND

There are many sources of natural gas production around the world. A good fraction of these are not located near markets for natural gas. A lesser but still significant fraction of these are separated from markets by oceans or seas.

The gas from these "stranded" sources of natural gas can be acquired for heavy discounts over world prices and therefore have the potential to be economically transported to distant markets for sale.

If the sea-going transport distances are large (over approximately 500 miles), liquid natural gas ("LNG") ships are typically used. While it takes substantial energy to liquify natural gas, the lower bulk density of LNG makes it economical for shipment over large distances. Even so, special facilities for handling and storing LNG must be available at both the port of origin and at the port of sale.

If the sea-going distances are short (less than approximately 500 miles), then it is usually more economical to ship natural gas as compressed natural gas ("CNG"). Both large ships and large barges have been proposed for transporting CNG, typically by filling large tubular pressure vessels with natural gas compressed to pressures in the approximate range of 500 psi to 5,000 psi.

A number of techniques have been proposed to optimize the economics of CNG ships and/or barges. These include, for example:

- the use of low temperature to chill the gas to increase its density as described in U.S. Pat. No. 6,725,671
- the use of low temperature to chill the gas plus the addition of some natural gas liquids ("NGLs"), carbon dioxide or a combination, all of which increase its density as described in U.S. Pat. No. 7,137,260
- the use of activated charcoal to absorb more natural gas at a lower pressures thereby allowing the use of lower pressure storage techniques
- the use of composite materials such as carbon filament wound pressure vessels thereby allowing the use of higher pressure and higher density gas storage.

Such technologies extend the range that CNG transport becomes more economical than LNG transport. CNG transport is more economical as it has the major advantage of not requiring special, and very expensive, facilities for handling and storing at both the port of origin and at the port of sale, such as required by LNG transport. In addition, a CNG transport ship or barge is much less expensive than an LNG transport ship or barge because of the expensive containment and safety requirements of an LNG transport vessel.

In addition, there are far fewer safety requirements for CNG loading, transport and unloading as compared to LNG transport. In fact, many countries which are prime natural gas markets only allow a few LNG ports to be installed because of the potential for LNG accidents and explosions. CNG transport has fewer safety requirements, largely because natural gas is lighter than air. If the cargo escapes in gaseous form, the gas disperses and rises quickly and mixes with the atmosphere. On the other hand, liquified natural gas can remain in concentrated pools on the surface until it all evaporates and is therefore vulnerable to an ignition source and resulting concentrated explosion.

Therefore, there is a need for methods and apparatuses that can extend the range of economical CNG transport so that stranded gas producing operations can provide much needed natural gas to more and more distant markets that cannot afford or will not allow LNG facilities.

SUMMARY

These and other needs are addressed by the present invention. The present invention is directed generally to the storage and transportation of natural gas by a vehicle.

In one embodiment, a (preferably buoyant) maritime vessel for transporting a gas includes: a deck; a hull; and a hold defined by the deck and hull; a plurality of gas storage containers in the hold; and at least one of a semi-solid and solid material positioned between adjacent gas storage containers, whereby the at least one of a semi-solid and solid material at least one of maintains the gas storage containers in substantially fixed positions relative to the hull and confines substantially a rupture of any gas storage container.

In another embodiment, a vehicle for transporting a gas includes: a plurality of interconnected gas storage containers; and at least one of a semi-solid and solid material positioned between and/or substantially surrounding adjacent gas storage containers, whereby the at least one of a semi-solid and solid material at least one of maintains the gas storage containers in substantially fixed positions relative to the hull and confines substantially a rupture of a gas storage container.

In another embodiment, a method for transporting a gas, such as natural gas, to a market includes the steps of: receiving, at a first location, a valuable gas stored in a plurality of gas storage containers carried by a vehicle, wherein at least one of a semi-solid and solid material substantially surrounds the gas storage containers, whereby the at least one of a semi-solid and solid material at least one of maintains the gas storage containers in substantially fixed positions relative to one another and confines substantially a rupture of a gas storage container; and relocating the vehicle and valuable gas storage containers to a second location, wherein, at the second location, the stored valuable gas is removed from the gas storage containers.

The various embodiments and configurations can provide a lightweight, inexpensive barge or other vehicle for transporting compressed natural gas. The construction of the compressed natural gas or CNG barge can be simplified by the use of various concretes to form the structure and containment for the plurality of interconnected, typically cylindrical, containers or pressure vessels. The plurality of interconnected cylindrical pressure vessels are formed primarily from pipe or tubing typically used in underground natural gas pipelines.

In one configuration, the CNG barge includes means for cooling the natural gas as it is compressed into the plurality of interconnected cylindrical pressure vessels. The barge may also include means for addition or release of ballast material so as to control the draft depth of the barge. This means of controlling draft depth may be used to allow the barge to be towed under water, if desired.

Unlike a tanker ship or barge that carries liquids, the CNG barge does not need separate tanks to provide stability from sloshing loads because the cargo of gas has relatively low inertia and is stabilized by its internal pressure. Therefore, additional piping and/or baffles are not required in a CNG barge.

The CNG barge is commonly constructed so that the deck may be used to transport cargo such as for example, vehicles, cargo containers and pallets of cargo.

The principal job of the CNG barge is to move natural gas from at least one natural gas source to at least one natural gas market on a regular schedule. Thus, a CNG barge can be used to carry other cargo between the scheduled ports of call. The route can be from a stranded source of natural gas to a distant market or from a source of natural gas to a distant stranded market.

The following definitions are used herein:

A barge as used herein is a marine vessel for transporting materials across any navigable waters. A barge may have a limited means of self-propulsion but is typically towed or pushed by another vessel such as for example a tug-boat. Several barges may be connected together and towed or pushed as a string of barges or group of barges. A barge is a flat-bed, shallow-draft vessel with little or no superstructure that is used for the transport of cargo. Transport barges or scows can be defined as cargo-carrying craft that are towed or pushed by a powered vessel on both inland and ocean waters. Large barges may have installed cargo handling or ballasting equipment, including pumps and piping for loading, shifting, or ballasting equipment. Ballast systems may be used for correcting trim, list, and stability problems imposed by cargo loading or casualty damage.

CNG means compressed natural gas.

A gas cylinder is a gas storage container typically fabricated from steel pipe or tubing and having its ends capped by typically welding on steel end-caps. Either or both of the steel end-caps may include a central threaded fitting for a valve and/or a pressure gage.

LNG means liquified natural gas.

Rheopectic means a non-Newtonian fluids that shows a time-dependent change in viscosity; the longer the fluid undergoes shear, the higher its viscosity.

A semi-solid refers to a flowable material, such as a highly viscous or rheopectic liquid or solid or a particulated material. An example of a highly viscous rheopectic liquid is certain types of gypsum pastes, and an example of a particulate material is sand.

A tow is a string of barges lashed together and pushed or towed by one or more tugs.

A vehicle is any mobile device, system, apparatus, or contrivance, whether or not self-propelled, towed, pushed, pulled, or hauled, for carrying selected objects, whether animate or inanimate, including, without limitation, a maritime vessel, such as a ship or barge, a railcar, a tractor trailer, and a truck.

As used herein, "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

DETAILED DESCRIPTION

CNG Barge Construction

Figure 1:
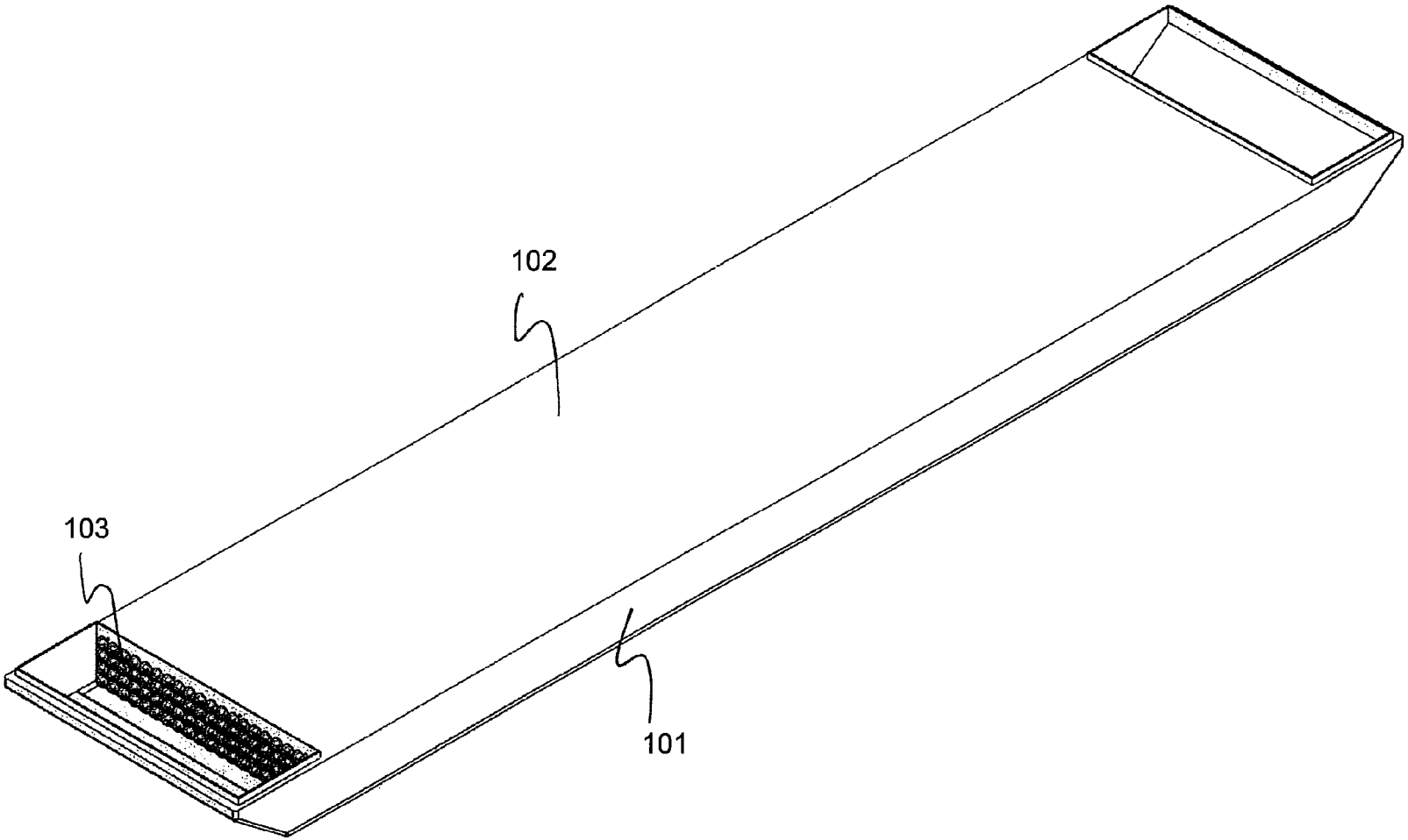
FIG. 1 is a schematic isometric view of a CNG barge of the present invention.

FIG. 1 is a schematic isometric view of a CNG barge of the present invention. Here a barge is comprised of a hull 101 and a deck 102. The interior or hold of the barge is filled with a plurality of interconnected cylindrical pressure vessels 103. As will be illustrated in FIG. 4, the cylindrical pressure vessels 103 are preferably fabricated from pipe or tubing that is commonly used for underground gas pipelines. Steel end caps and connector pipes connecting the capped steel cylinders form an interconnected storage system that can be filled and emptied from one or several locations. The connector pipes may include shut-off valves. Connector pipes may also bypass every other cylinder or groups of cylinders so that, if a leak occurs in a cylinder, that cylinder or the group of cylinders that the leaking cylinder is in, may be by-passed and removed from participating in the storage system. The barge is formed from a hull 101 which may be a hard shell made from steel, high-strength concrete or the like. The network of interconnected pressure vessels 103 is fabricated inside the empty hull 101. Passage ways, service areas and other required openings are built into the vessel by forms. Then the rest of the interior is filled with light-weight concrete or combinations of concrete and inexpensive spacing materials as described in FIG. 4.

In this way, the pressure vessels are immersed in concrete and this allows the use of piping suitable for underground natural gas pipelines. Underground natural gas pipelines are engineered to a lower factor of safety than above-ground pressure vessels because the ground provides the underground pipe with stability and isolation from shrapnel in the case of an underground leak and explosion. The concrete also provides structural rigidity for the barge as a whole. This general method of construction allows flexibility in the design of subsequent barges since the forms that define passage ways, service areas and other required openings are relatively easy to modify.

As will be discussed in FIGS. 6 and 7, the deck 102 of a CNG barge can be used to transport other materials or goods. This substantially increases the utility of a barge transport system.

Figure 2:
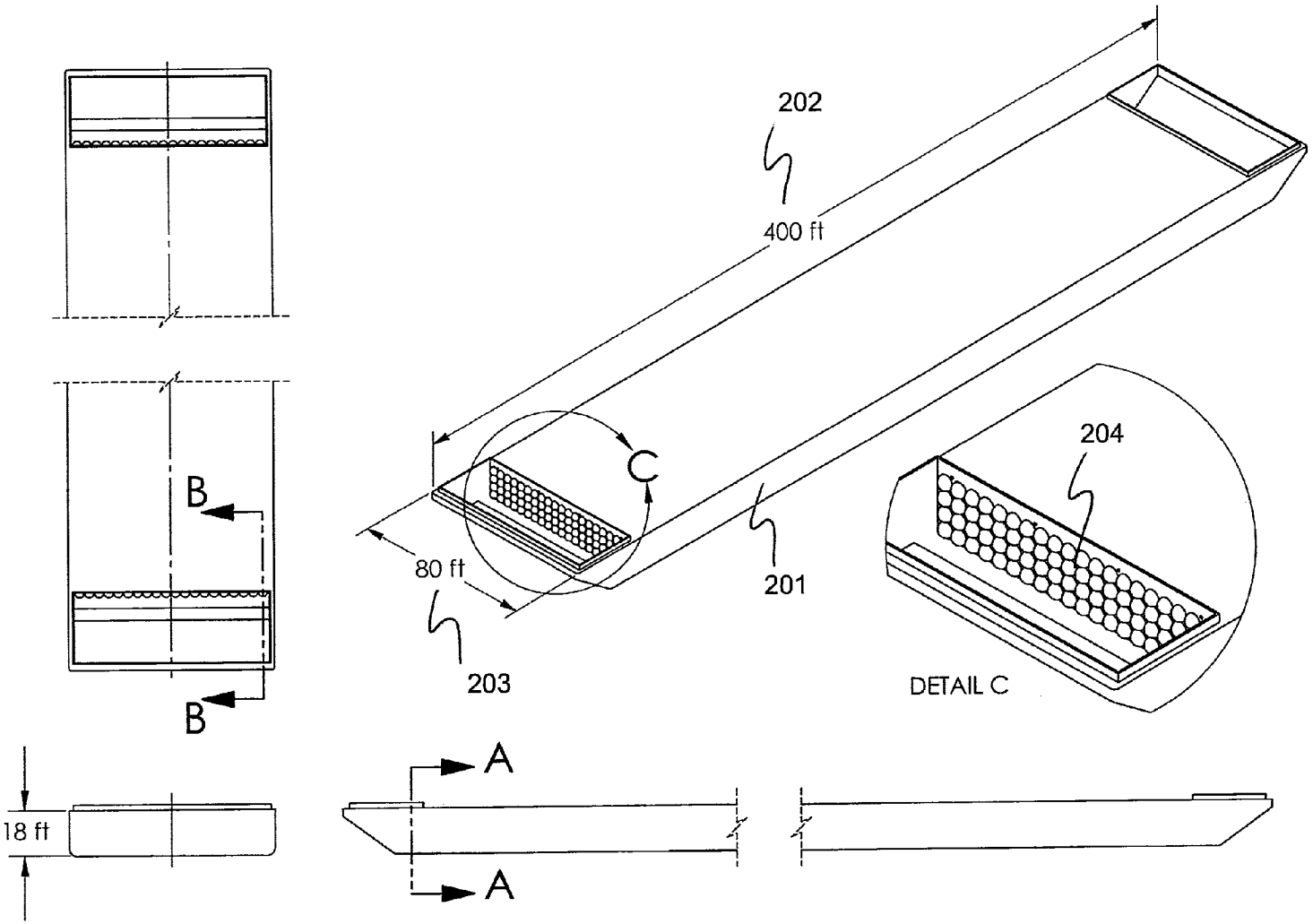
FIG. 2 shows several schematic views of a CNG barge of the present invention.

FIG. 2 shows three schematic views of a CNG barge of the present invention. The barge 201 depicted in FIG. 2 has a length 202 of 400 feet and, in practice could have a length in the range of approximately about 200 feet to about 1,000 feet. The barge 201 depicted in FIG. 2 has a width 203 of 80 feet and, in practice could have a width in the range of approximately about 50 feet to about 100 feet. The barge depicted in FIG. 2 in the end view has a depth 204 of 18 feet and, in practice could have a depth in the range of approximately about 15 feet to about 35 feet. The piping 204 used as pressure vessels is steel pipe such as used in underground natural gas pipelines and has a nominal diameter in the range of approximately about 12 inches to about 60 inches. Pipeline quality steel has a nominal yield strength in the range of about 80,000 psi to about 120,000 psi. Pipelines are operated at gas pressures in the range of up to approximately 2,000 psi.

Figure 3:
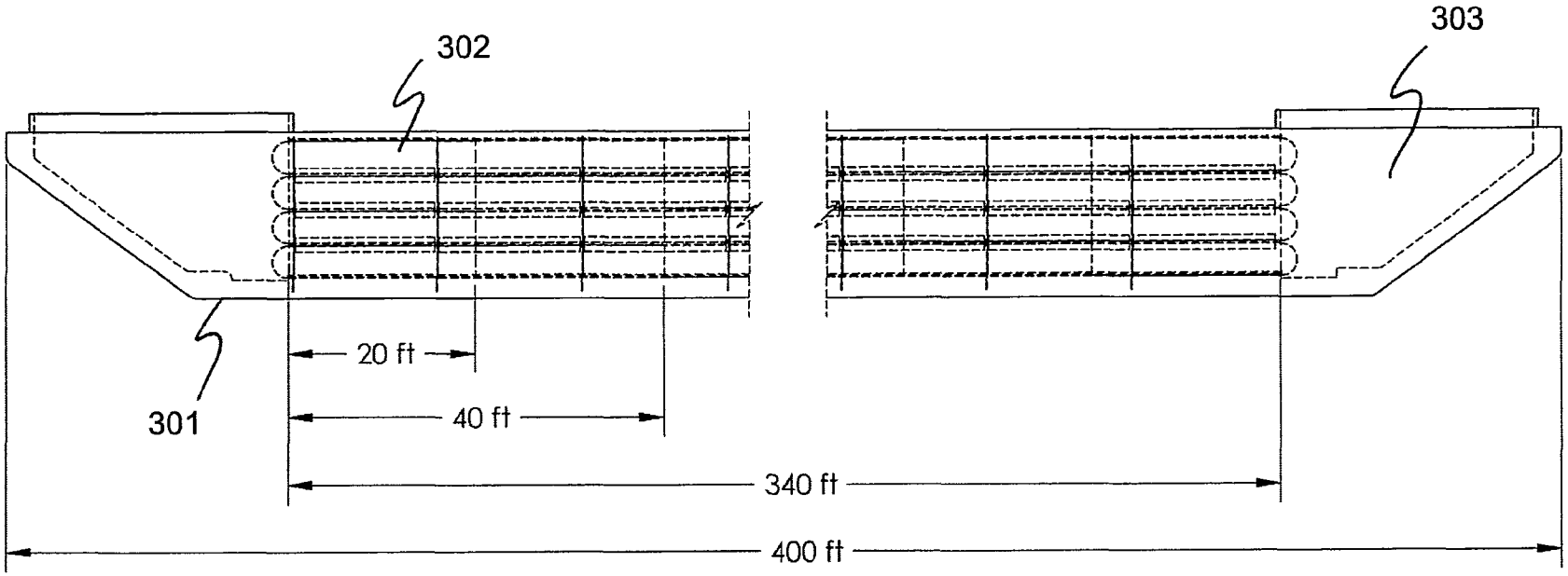
FIG. 3 shows a schematic side view of a section through a CNG barge of the present invention.

FIG. 3 shows a schematic side view of a section through a CNG barge of the present invention. The barge 301 shown in this example is about 400 feet in length. A number of interconnected steel pipes 302 are shown occupying about 340 feet of length centered in the barge. The tanks 302 formed by steel pipe such as used in underground natural gas pipelines and is shown here with a nominal diameter of about 42 inches. The spaces 302 fore and aft are available for compressor, pumping and other equipment required for loading, unloading and controlling gas handling during operation.

The tanks 302 are held in place by a matrix of reinforcing steel bar ("re-bar") and then a lightweight concrete is poured around the assembly to provide strength and protection against pipe rupture.

As an example of typical barge dimensions, a barge may be 400 feet long by 80 ft wide and 18 feet high plus a 2 foot splash guard. The outside walls of the barge are 2 feet thick. The access to the storage pipes is about 6 feet wide). The pipes that form the storage tanks have nominal diameters of 42 inches and wall thickness of about 0.536 inches. These storage tanks will have a nominal operating pressure of about 2,000 to about 2,200 psi if 120,000 psi yield steel is used. The distance between the pipes, center to center is 45 inches. There is a 0.25 inch thick insulation layer around each pipe. Vertical and horizontal rebar forms a matrix spaced at 10 feet along the length of pipes and 5 feet across the pipes. The rebar is typically ½ inch diameter. The rebar in the outside walls and the bottom are 1 inch diameter.

The barge may also include means for addition or release of ballast material so as to control the draft depth of the barge. This means of controlling draft depth may be used to allow the barge to be towed under water, if desired. For example, ballast tanks may be molded into the barge structure as ballast tank fore and aft or as concrete cylinders along the length of the barge. Normally the ballast tanks are filled with ambient air so that the upper portion of the barge is above water. The ballast tanks can be partially of completely filled with water to allow the barge to float low in the water or beneath the surface of the water. The latter capability may be an advantage in the case of rough seas. The ballast may be introduced or expelled by any of a number of known ballast control system.

Control of barge draft may also be accomplished or assisted by control surfaces such as used on submarines. Control surfaces may be used to trim the draft depth of individual barges or to provide the necessary downward force to allow the barges to submerge.

Figure 4:
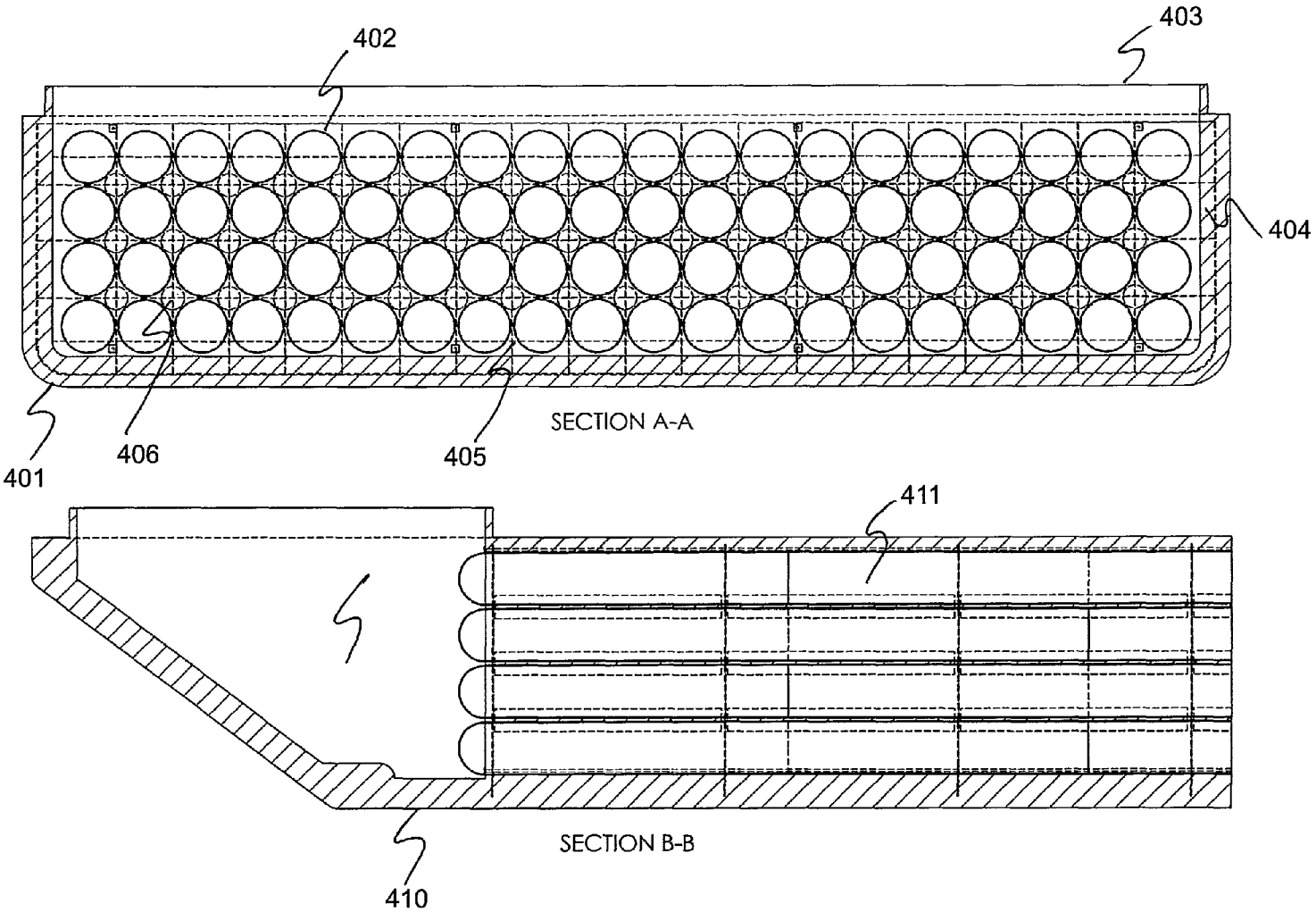
FIG. 4 shows a schematic end view of a section and a partial a schematic side view of a section, both through a CNG barge of the present invention.

FIG. 4 shows a schematic end view of a section and a partial a schematic side view of a section, both through a CNG barge of the present invention. Section B-B shows a side view of a gas barge of the present invention with forward space 412 and gas storage tanks 411. The hull of the barge 410 is formed of structural steel typically with a skin in the range of about ⅛ inches to about 1 inch thick or from hard high strength concrete typically in the range of 5 to 30 inches thick. If the hull is formed from concrete, then the concrete may be re-enforced with re-bar typically from about 0.5 to about 1.5 inches in diameter.

Section A-A shows a cross-section of the width and height of the barge. Tanks 402 are shown nested in a matrix of re-bar (represented by dotted lines). The space in between pipes is filled with either lightweight concrete of normal concrete with holes 406 running along the length of the pipes. The holes 406 reduce the overall density of the structure and may be used as part of a ballast system.

As described previously, the present invention includes a means of allowing expansion of pipe length and diameter as temperature and pressure in the gas contained within the pipes changes. The pipes are allowed to move within a sleeve around each pipe, either by changing pipe diameter or pipe length. The concrete and re-bar matrix that surrounds the pipes is clamped longitudinally and maintained in compression. This can be accomplished, for example, by large steel plates on either end of the tank assembly which can be pulled together to maintain the concrete and re-bar matrix in compression. The end plates can be pulled together, for example, by a number of threaded steel rods running through the tank assembly which can be tightened by large nuts on threaded ends of the bars.

Figure 5:
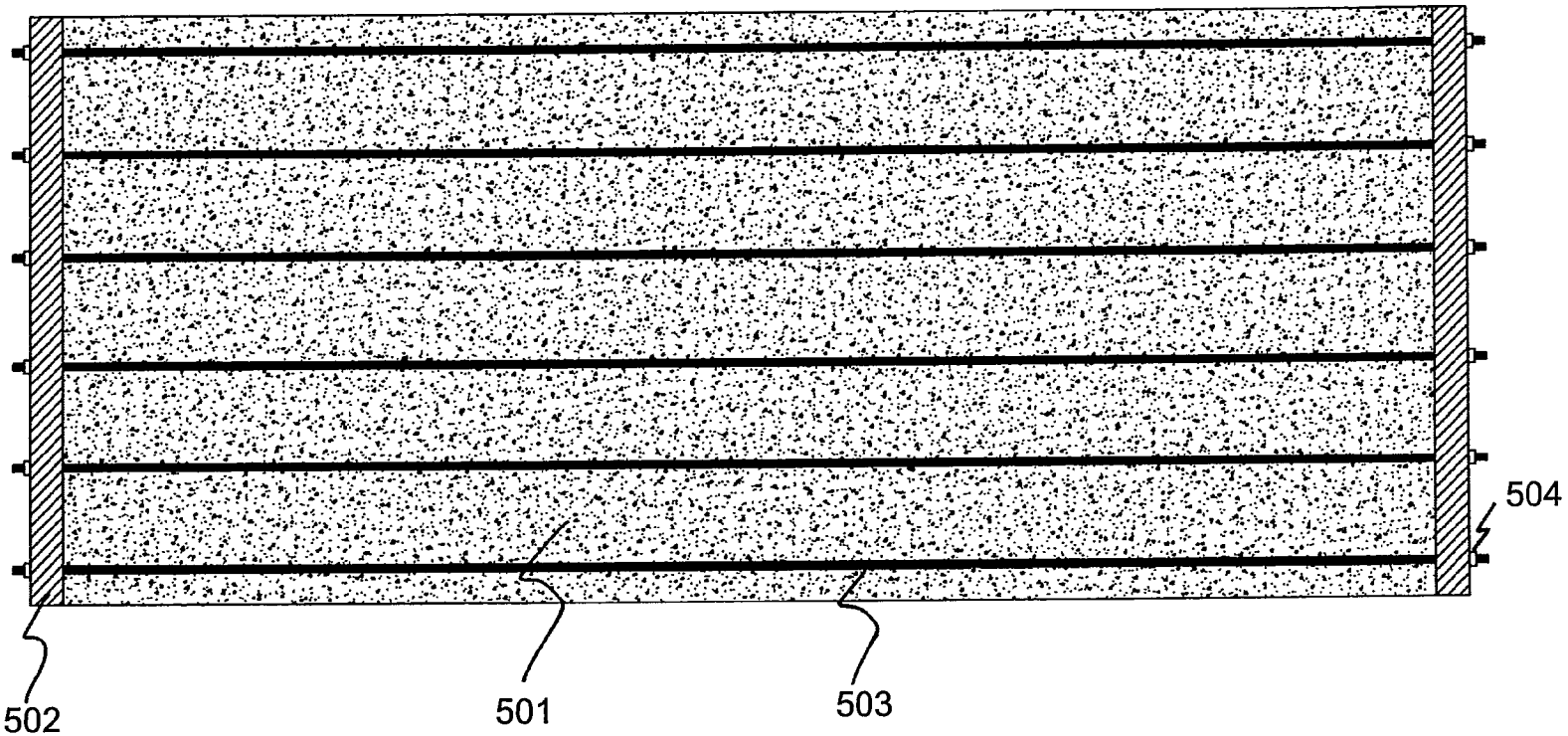
FIG. 5 is a schematic of a concrete compression system.

FIG. 5 is a schematic of a concrete compression system. This figure illustrates the principle of constructing a stable concrete and gas cylinder matrix that can withstand the rigors of ocean transport. Plates 502 and 504 form the end pieces of a matrix that contains the gas cylinders (not shown). Long rods 503 with threaded ends 504 hold the plates and matrix together. The matrix of concrete and gas cylinders is built up, preferably in layers, until all the gas cylinders are installed and embedded in concrete 501. The concrete 501 in the matrix is put under compression by tensioning rods 503. The concrete is compressed to a stress in the range of about 100 to about 500 psia. As will be described in FIG. 6, the gas cylinders are inserted into sleeves embedded in the concrete matrix so that the gas cylinders can expand and contract with both pressure and/or temperature. While FIG. 5 is discussed with reference to concrete, it is to be appreciated that any semi-solid or solid substance having sufficient strength or viscosity characteristics to withstand gas cylinder movement during transportation and/or explosion can be employed, such as cement, grout, resin, plastic, adhesive, mortar, plaster, and gypsum paste.

Figure 6:
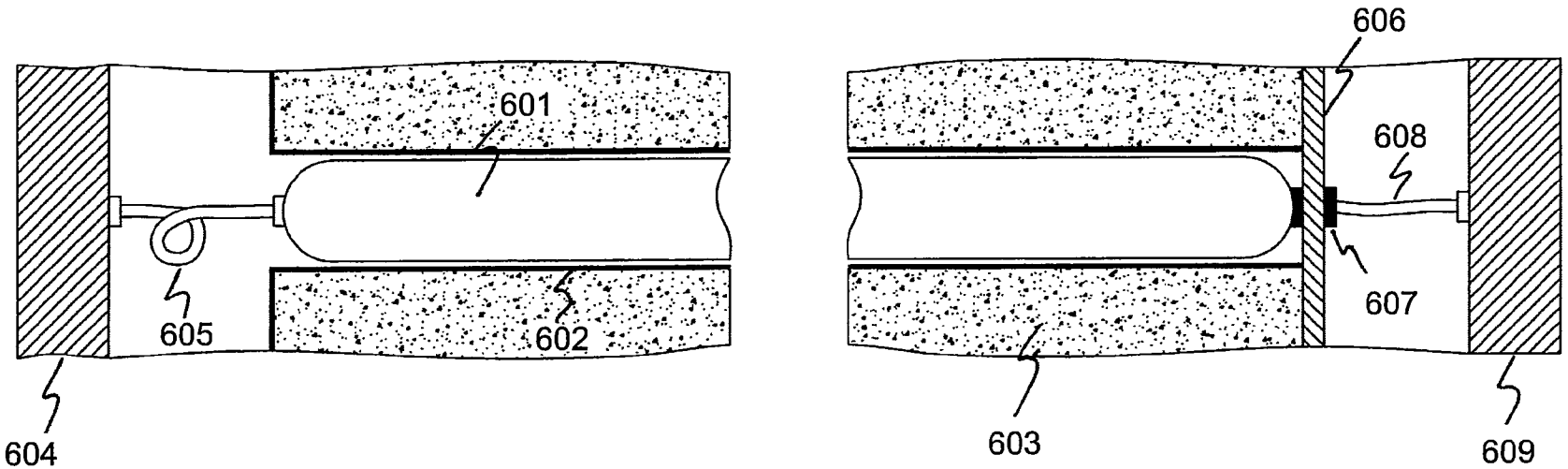
FIG. 6 is a schematic of an expandable gas cylinder containment system.

FIG. 6 is a schematic of an expandable gas cylinder containment system of the present invention. A gas cylinder 601 is inserted inside a sleeve 602. The sleeve is preferably made of carbon steel but may be made from other materials such as alloy steel, aluminum, cardboard, plastic tubing such as ABS or PVC or any other suitable material. The sleeve 602 is embedded in concrete 603. At one end, the cylinder 601 is attached to a plate 606 by a clamp 607. In this configuration, the cylinder is connected to a manifold 609 by a flexible hose 608. At the opposite end, the cylinder 601 is free to move as a result of expansion or contraction due to temperature change or pressure variation as the gas cylinder 601 is pressurized or vented. The cylinder 601 can change its length or diameter while retaining clearance with sleeve 602. The cylinder is connected to a manifold 604 by a flexible hose 605 which has sufficient slack to accommodate the full range of lengthwise motion of gas cylinder 601. There is sufficient room and access around the ends of the cylinder for maintenance or trouble shooting.

It is also possible to eliminate the sleeve by using an over-expanded gas cylinder to form a cavity in the concrete. When the pressure in the over-expanded gas cylinder is relieved, the gas cylinder can be withdrawn or left in place but never over-pressurized during operation.

Loading, Cooling and Unloading of Compressed Gas

Figure 7:
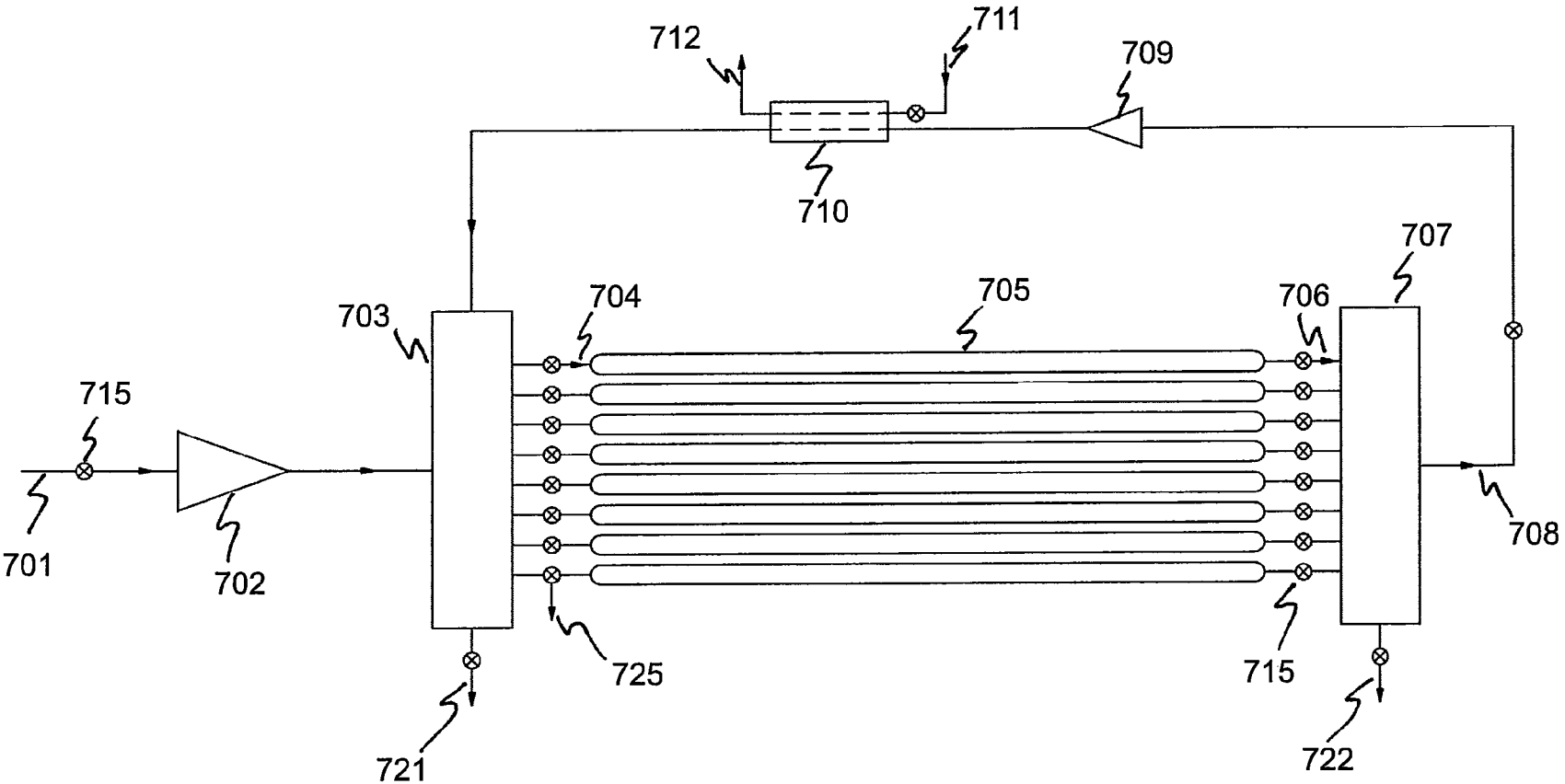
FIG. 7 is a schematic of a CNG loading, cooling and unloading system.

FIG. 7 is a schematic of a compressed gas CNG loading, cooling and unloading system. Natural gas is introduced to the barge cylinder storage system via path 701 and compressor 702 to a manifold 703. Manifold 703 distributes gas to gas cylinders 705 via flexible piping 704. As can be seen gas cylinders 705 are filled in parallel. This allows a cylinder to be valved off in the event of a gas leak or if a full load is not required. On-off valves 715 are shown in various locations in the system. Valves 725 at one or both ends of each cylinder 705 allow individual cylinders to be vented to atmosphere (path 721), if necessary, during maintenance or other situations. Compressor 702 heats the gas above ambient temperature as it fills cylinders 705. Compressor 702 may have an after-cooler to lower temperature of the gas back towards ambient temperature. The gas in cylinders 705 is then sent via lines 706 to a second manifold 707 where it is circulated by a pump 709 via line 708 through a heat exchanger 710. Heat is removed from the gas as it passes through heat exchanger 710 by sea, lake or river water which circulates from inlet 711 through the heat exchanger 710 and back into the sea, lake or river via outlet 712. Alternately, the heat exchanger can cool the gas by using ambient air to remove heat from the gas as it passes through heat exchanger 710. The cooled gas is then returned to cylinders 705 via manifold 703. This system allows the gas to be maintained in the cylinders 705 at or near ambient temperature of the sea, lake or river water. A similar gas cooling system is disclosed in U.S. Pat. No. 4,749,384 which uses air, not water, as the cooling fluid. The gas in cylinders 705 may be unloaded to an on-shore storage facility or vented to atmosphere in an emergency via path 721 from manifold 703 and/or via path 722 from manifold 707.

On-Deck Cargo

Figures 8, 8A, 8B:
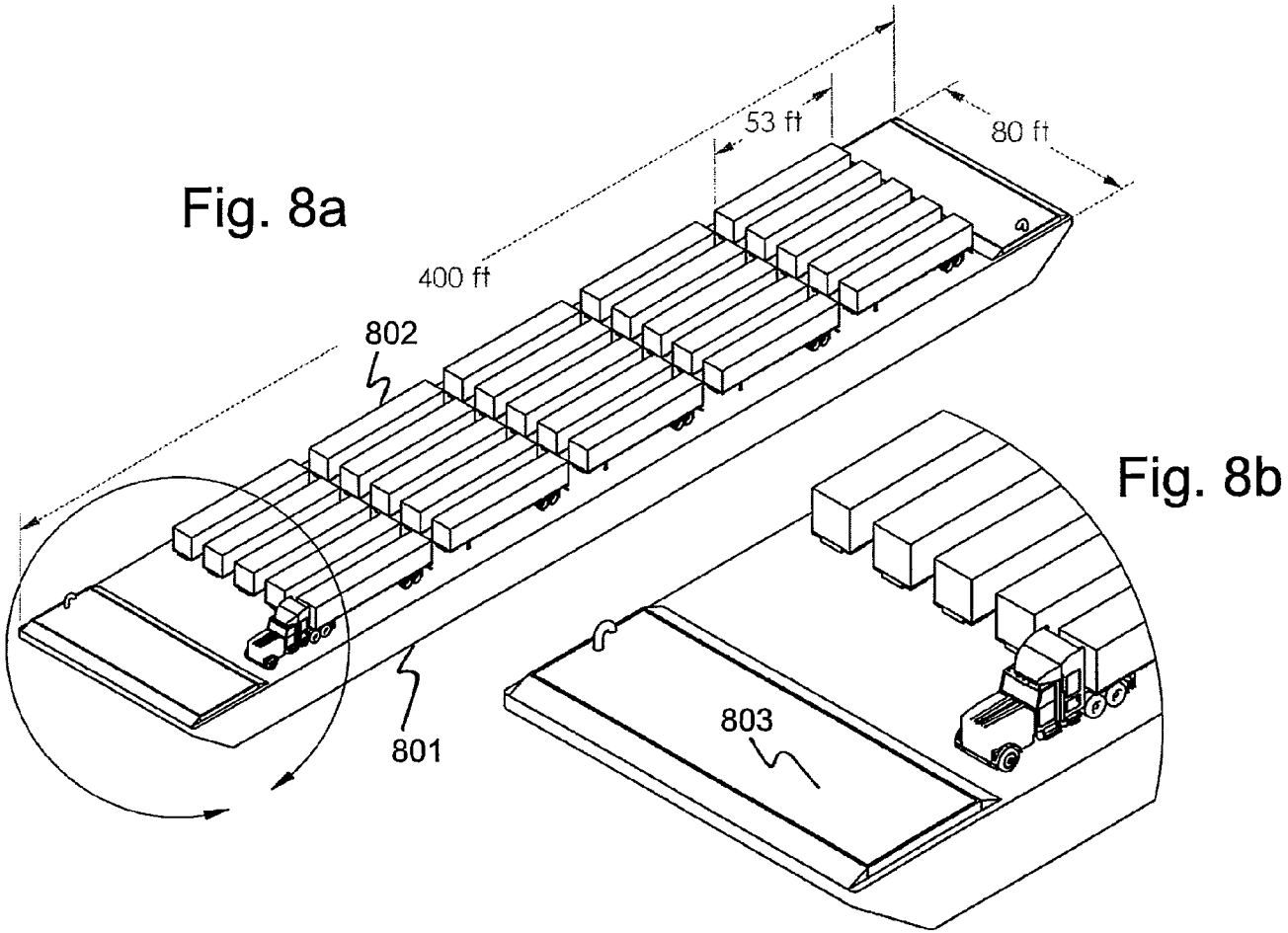
FIG. 8 is a schematic of a CNG barge with on-deck cargo.

FIG. 8 is a schematic of a CNG barge with on-deck cargo. Since the deck of the barge of the present invention has no external plumbing for filling the below-deck CNG cylinders, it can be used for transporting other cargo. For example, the deck can be used to carry vehicles, cargo containers, pallets of cargo and the like. FIG. 8*a* shows a CNG barge 801 with transport trailers 802 on the deck. This deck also serves as a membrane or barrier from any gas leaking from below. FIG. 8*b* shows a close-up of the front of the deck showing a hatch cover 803 that forms a ramp over the end of the deck for loading, transporting and unloading on-deck cargo.

Figure 9:
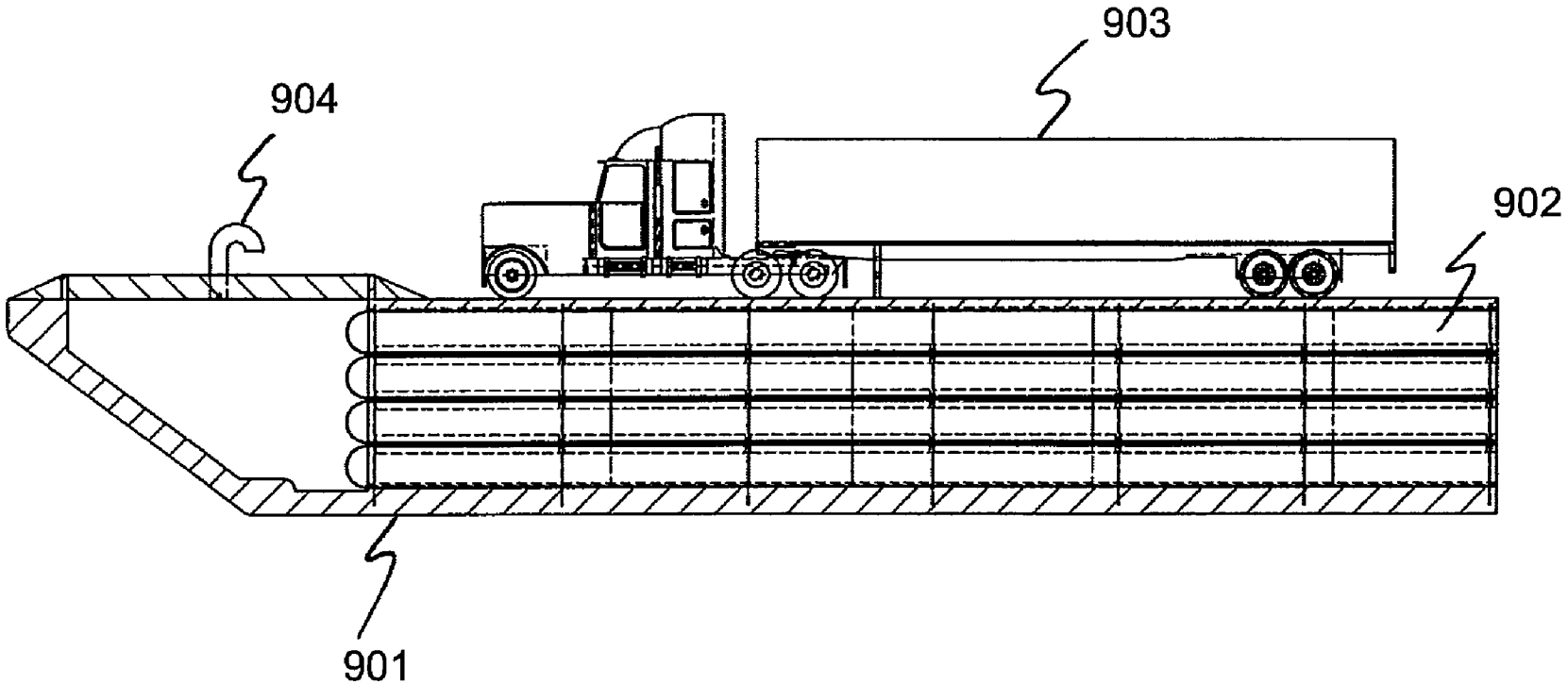
FIG. 9 is a schematic of on-deck cargo and venting.

FIG. 9 is a schematic of on-deck cargo and venting. This sectional side view shows a CNG barge 901 with embedded gas cylinders 902 below deck and trucks 903 as on-deck cargo. This figure also shows a typical vent 904 which is included to allow any natural gas that leaks from the embedded CNG system from accumulating below deck. The CNG barge of the present invention whether it carries only natural gas as cargo or both natural gas and on-deck cargo, will have all its internal spaces well ventilated with multiple vents. These vents can include fans to help move any leaking gas to the outside but the barge will fundamentally rely on passive vents that will allow any natural gas, which is lighter than air, to escape by providing an upward path.

Scheduled Commodity Delivery

Figure 10:
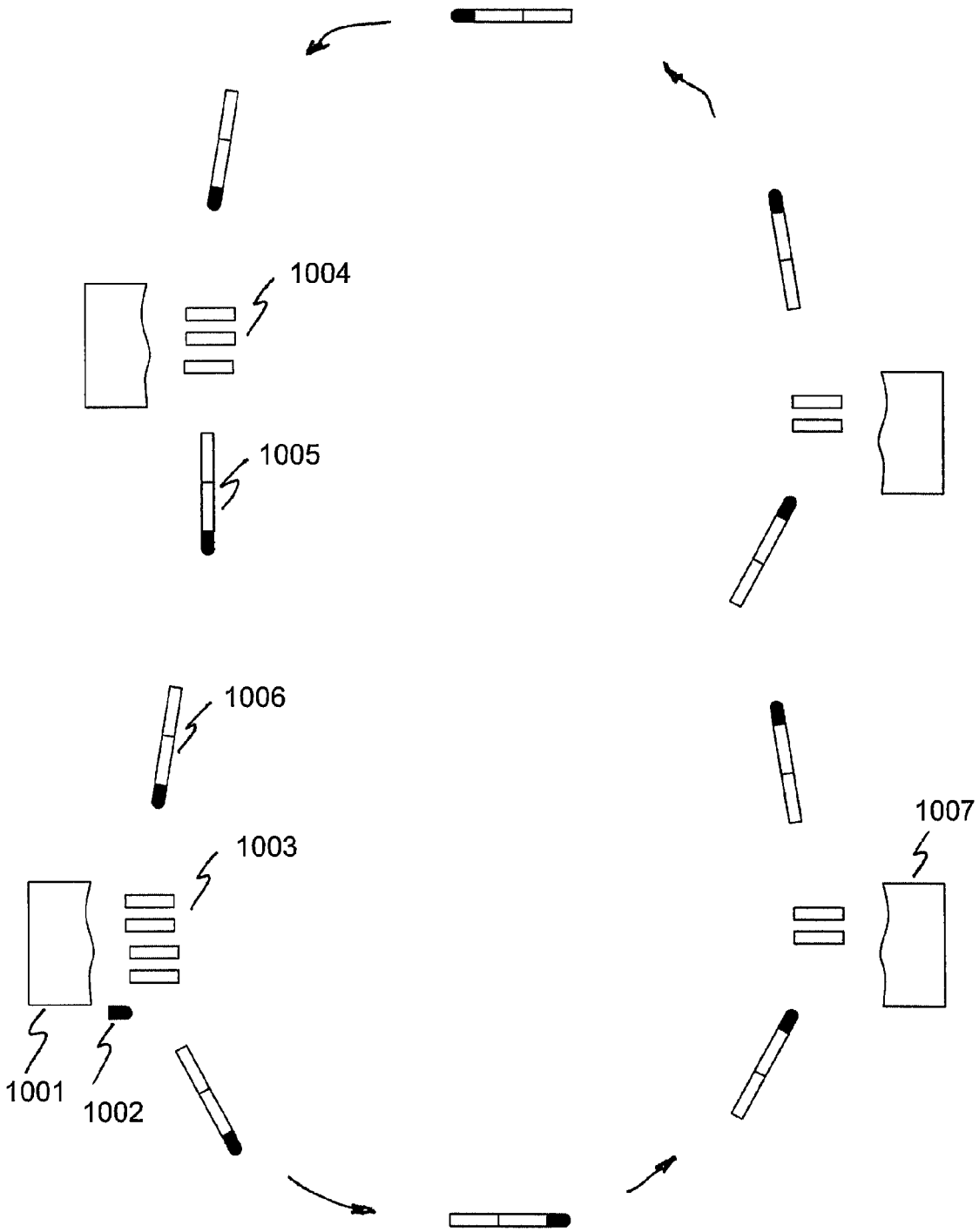
FIG. 10 is a schematic of a typical CNG gas-barge delivery route system.

FIG. 10 is a schematic of a typical CNG barge delivery route system. The CNG barge of the present invention has a flat deck which is available to carry cargo such as, for example, vehicles, containers, cargo pallets and the like. The principal job of the CNG barge is to move natural gas from at least one source to at least one market on a regular schedule. Thus, it is a natural extension to carry other cargo between the scheduled ports of call. FIG. 10 illustrates an example of this process. CNG barges 1003 are loaded with natural gas at least at one source of natural gas 1001. When one or more CNG barges are fully loaded with natural gas and, if available, additional deck cargo, then a tug 1002 is used to form a string of barges which can be pushed or pulled by a tug or tugs to a first port of call 1007. As can be appreciated, the route can be from a stranded source of natural gas to a distant market or from a source of natural gas to a distant stranded market. FIG. 10 shows an example of a natural gas source port 1001 and 3 other ports where natural gas or cargo or both are delivered on a regular schedule. As can be appreciated, a route can be comprised of one natural gas source port and one market port or a plurality of natural gas source ports and a plurality of market ports.

In a preferred mode, CNG barges are moved to a port of call and released by the tug or tugs so that natural gas and cargo can be unloaded. The tugs are then free to pick up previously unloaded barges and move them to the next port of call on the route. This maximizes the use of the tugs by eliminating unnecessary waiting for unloading and reloading of the barges.

Propulsion

The CNG barges can be self-propelled or they can be moved by tugs. It is preferable that the CNG barges, if self-propelled, use an engine or engines that can operate on natural gas and even more preferable if the engine or engines can operate on more than one fuel (for example, switch between natural gas and diesel). If moved by tugs, it is preferable that the tugs use an engine or engines that can operate on natural gas and even more preferable if the engine or engines can operate on more than one fuel.

If the CNG barges can be self-propelled, it is possible to use a single large engine in the power range of about 2,500 Kw to about 20,000 kW. It is also possible and preferable to use many smaller engines distributed throughout the front and rear under-deck compartments. These engines can be configured to output electrical energy to a common electrical bus that, in turn, provides electrical power to propulsion motors associated with each screw.

A number of variations and modifications of the inventions can be used. As will be appreciated, it would be possible to provide for some features of the inventions without providing others. For example, the basic construction and containment procedures can be used to fabricate CNG rail cars or CNG tractor trailers for rail and road haulage respectively.

The present invention, in various embodiments, includes components, methods, processes, systems and/or apparatus substantially as depicted and described herein, including various embodiments, sub-combinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, for example for improving performance, achieving ease and\or reducing cost of implementation.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover though the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A maritime vessel, comprising:

a deck;

a hull;

a hold defined by the deck and hull;

a plurality of gas storage containers in the hold; and at least one of a semi-solid and solid material positioned between adjacent gas storage containers, whereby the at least one of a semi-solid and solid material at least one of maintains the gas storage containers in substantially fixed positions relative to the hull and confines substantially a rupture of any gas storage container;

wherein the at least one of the plurality of gas storage containers and the at least one of a semi-solid and solid material provide substantial structural integrity to the maritime vessel;

wherein the at least one of a semi-solid and solid material is maintained in compression by opposing, interconnected structural members; and wherein the interconnected structural members are positioned within the hull and connected at one or more substantially longitudinal positions.

2. The maritime vessel of claim 1, wherein the plurality of gas storage containers are gas cylinders, wherein the stored gas is natural gas, and wherein at least some of the gas cylinders are interconnected by one or more manifolds.

3. The maritime vessel of claim 2, wherein the at least one of a semi-solid and solid material is concrete and comprises reinforcing steel bar.

4. The maritime vessel of claim 2, wherein the at least some of the gas cylinders are connected to a manifold by a flexible connector conduit, wherein the connector conduit comprises a shut-off valve, wherein diameters of the gas cylinders range from about 12 to about 60 inches, and wherein the gas cylinders have a nominal yield strength of from about 80,000 to about 120,000 psi.

5. The maritime vessel of claim 1, further comprising:

means for adding and/or releasing ballast to control a degree of buoyancy of the vessel to position, in a first mode, the deck above a water surface and, in a second mode, the deck below the water surface.

6. The maritime vessel of claim 1, further comprising:

a sleeve embedded in the at least one of a semi-solid and a solid material positioned around each gas storage container, wherein the sleeve permits the enclosed gas storage container to thermally expand and contract in diameter and/or length, and wherein the respective sleeve has an inner diameter larger than an outer diameter of the gas storage container positioned in the respective sleeve.

7. A method, comprising:

(a) receiving, at a first location, a valuable gas stored in a plurality of gas storage containers carried by a vehicle, wherein the vehicle comprises a deck and a hull, wherein at least one of a semi-solid and solid material substantially surrounds the gas storage containers, whereby the at least one of a semi-solid and solid material at least one of maintains the gas storage containers in substantially fixed positions relative to one another and confines substantially a rupture of any gas storage container, wherein at least one of the plurality of gas storage containers carried by the vehicle and the at least one of a semi-solid and solid material provide substantial structural integrity to the maritime vehicle, wherein the at least one of a semi-solid and solid material is maintained in compression by opposing, interconnected structural members, wherein the interconnected structural members are positioned within the hull and connected at one or more substantially longitudinal positions; and (b) relocating the vehicle and gas storage containers to a second location, wherein, at the second location, the stored valuable gas is removed from the gas storage containers.

8. The method of claim 7, wherein the plurality of gas storage containers are gas cylinders, wherein the stored gas is natural gas, and wherein at least some of the gas cylinders are interconnected by one or more manifolds, and further comprising:

at least one of isolating and venting a selected gas storage container from fluid communication with the one or more manifolds by closing one or more valves.

9. The method of claim 8, wherein the at least one of a semi-solid and solid material is concrete and comprises reinforcing members and wherein the at least one of a semi-solid and solid material is maintained in compression ranging from about 100 to about 500 psia.

10. The method of claim 7, wherein first ends of at least some of the gas storage containers are interconnected by a first manifold, wherein second ends of the at least some of the gas storage containers are interconnected by a second manifold, wherein each of the at least some of the gas storage containers can be isolated from the first and second manifolds by shut-off valves, wherein diameters of the gas storage containers range from about 12 to about 60 inches, and wherein the gas storage containers have a nominal yield strength of from about 80,000 to about 120,000 psi.

11. The method of claim 7, wherein the vehicle is a maritime vessel and further comprising:

adding and/or releasing ballast to control a degree of buoyancy of the maritime vessel to position, in a first mode, the deck above a water surface and, in a second mode, the deck below the water surface.

12. The method of claim 7, wherein a stationary sleeve is positioned around each gas storage container and embedded in the at least one of a semi-solid and solid material and permits the enclosed gas storage containers to thermally expand and contract in diameter and/or length and wherein an inner diameter of the stationary sleeve is greater than an outer diameter of the respective gas storage container positioned in the sleeve.

13. The method of claim 7, during vehicle relocation further comprising:

(c) after charging of the valuable gas to a selected gas storage container, removing a portion of the valuable gas from the selected gas storage container;

(d) passing the removed valuable gas through a heat exchanger to remove heat from the removed valuable gas;

(e) circulating a heat exchange medium through the heat exchanger to transfer the removed heat to the heat exchange medium; and (f) introducing the cooled, removed valuable gas to at least one of the plurality of gas storage containers.

14. The method of claim 7, wherein the vehicle is a maritime vessel and further comprising after step (a):

loading cargo onto the deck of the vessel, the deck being positioned above the gas storage containers; and after relocating to a second location unloading the cargo at the second location.

15. The method of claim 7, wherein the valuable gas is natural gas and further comprising:

(c) providing at least a portion of the stored natural gas to an engine to displace the vehicle from the first location to the second location.

16. A maritime vehicle, comprising:

a deck;

a hull;

a plurality of interconnected gas storage containers; and at least one of a semi-solid and solid material positioned between and/or substantially surrounding adjacent gas storage containers, whereby the at least one of a semi-solid and solid material at least one of maintains the gas storage containers in substantially fixed positions relative to the maritime vehicle and confines substantially a rupture of any gas storage container;

wherein at least one of the plurality of gas storage containers and the at least one of a semi-solid and solid material provide substantial structural integrity to the maritime vehicle, wherein at least one of a semi-solid and solid material is maintained in compression by opposing, interconnected structural members, wherein the interconnected structural members are positioned within the hull and connected at one or more substantially longitudinal positions.

17. The maritime vehicle of claim 16, wherein the plurality of gas storage containers are gas cylinders, wherein the stored gas is natural gas, wherein the at least one of a semi-solid and solid material is concrete and comprises reinforcing steel bar.

18. The maritime vehicle of claim 17, wherein the at least some of the gas cylinders are interconnected by a manifold, wherein a shut-off valve is positioned along a corresponding fluid communication path between each of the at least some of the gas cylinders and the manifold, wherein diameters of the gas cylinders range from about 12 to about 60 inches, and wherein the gas cylinders have a nominal yield strength of from about 80,000 to about 120,000 psi.

19. The maritime vehicle of claim 16, further comprising:

a sleeve positioned around each gas storage container and embedded in the at least one of a semi-solid and solid material, the sleeve permitting the corresponding enclosed gas storage container to thermally expand and contract in diameter and/or length, wherein the respective sleeve has an inner diameter larger than an outer diameter of the corresponding enclosed gas storage container and wherein each of the enclosed gas storage containers is attached to one or more structural members to maintain the corresponding enclosed gas storage container substantially stationary in the sleeve.

* * * * *